US005191837A

United States Patent [19]

Bolton

[11] Patent Number: 5,191,837

[45] Date of Patent: Mar. 9, 1993

[54] HAND STAMP WITH FOLDING HANDLE

[75] Inventor: John G. Bolton, Camberwell, Australia

[73] Assignee: Chusid Pty. Ltd., Australia

[21] Appl. No.: 601,752

[22] PCT Filed: Apr. 24, 1989

[86] PCT No.: PCT/AU89/00179

§ 371 Date: Jan. 3, 1991

§ 102(e) Date: Jan. 3, 1991

[87] PCT Pub. No.: WO89/10267

PCT Pub. Date: Nov. 2, 1989

[30] Foreign Application Priority Data

Apr. 27, 1988 [AU] Australia ..... PI7984
Aug. 15, 1988 [AU] Australia ..... PI9859

[51] Int. Cl.[5] ..... B41K 1/54; B41K 1/56

[52] U.S. Cl. ..... 101/333; 101/405; 101/406

[58] Field of Search ..... 101/333, 31.1, 405, 101/406

[56] References Cited

U.S. PATENT DOCUMENTS 1,431,842 10/1922 Rauch ..... 101/405
3,279,359 9/1964 Meyer ..... 101/335
3,302,566 2/1967 Blanchet ..... 101/405
3,855,925 12/1974 Funahashi ..... 101/333
3,973,495 8/1976 Rowe ..... 101/405
4,003,309 1/1977 Munson ..... 101/406
4,395,948 8/1983 Monich ..... 101/405
4,697,513 10/1987 Faber ..... 101/405
4,928,594 5/1990 Bostick ..... 101/405

FOREIGN PATENT DOCUMENTS 1235492 5/1960 France .
1560974 3/1969 France .

*Primary Examiner*—Edgar S. Burr
*Assistant Examiner*—Lynn D. Hendrickson
*Attorney, Agent, or Firm*—Burns, Doane, Swecker & Mathis

[57] ABSTRACT

A hand stamp has a base and a handle which is movable between two folded positions and an operational position between the folded positions. The handle has legs with respective axles which are adapted to enter a bore in the base. There are lugs on respective axles which are adapted to cooperate with the respective one of the notches in the base to lock the handle in one operational position and two transportation positions. The handle is firmly but releasably held in each of the operational position and the transportation positions.

5 Claims, 2 Drawing Sheets

HAND STAMP WITH FOLDING HANDLE

This invention relates to hand or rubber stamps of the type used to apply various kinds of markings to documents. In particular, the stamp may be one which applies a corporate seal when a document is being executed on be half of the corporation or company concerned.

Conventional rubber stamps—those that are not self-inking—include a stamping portion and a handle. The stamping portion includes a backing plate (to which the handle is secured) and an ink-applying element or impression block (which may be of rubber or a plastics material) bearing an impression of the desired words and/or devices, which is secured to the backing plate.

AU-B-86866/75 describes a stamp in which the backing plate is in two parts, one part being of transparent plastics material so that the word(s) and/or device(s) of the impression block, which have been applied to a proof plate, are visible from above the backing plate.

Although some hand stamps—including those manufactured in accordance with AU-B-86866/75—are supplied to the end user with the handle detached, the resulting 'package' of handle and backing portion is still bulky, and as such is inconvenient for posting purposes or for being carried by a person. Often, it is necessary to carry a corporate seal stamp around on one's person and the bulk of conventional hand stamps does not lend itself to such transportation. In addition, where a handle has been detached, it is incovenient to attach and then detach the handle when it is desired to use the stamp.

It is an object of this invention to provide an improved, more easily transportable, rubber stamp.

The invention provides a stamp for applying a marking, comprising a handle and a base, wherein said stamp has a handle which may be manually gripped in order to effect the applying of said marking, characterized in that said handle is adapted to be moveable between an operational position wherein the handle is located in a plane normal to that of the base and a transportaion position wherein the handle is located in a plane parallel to that on the base.

A preferred embodiment of the invention will be described in detail hereinafter with reference to the accompanying drawings, in which.

Figure 1:
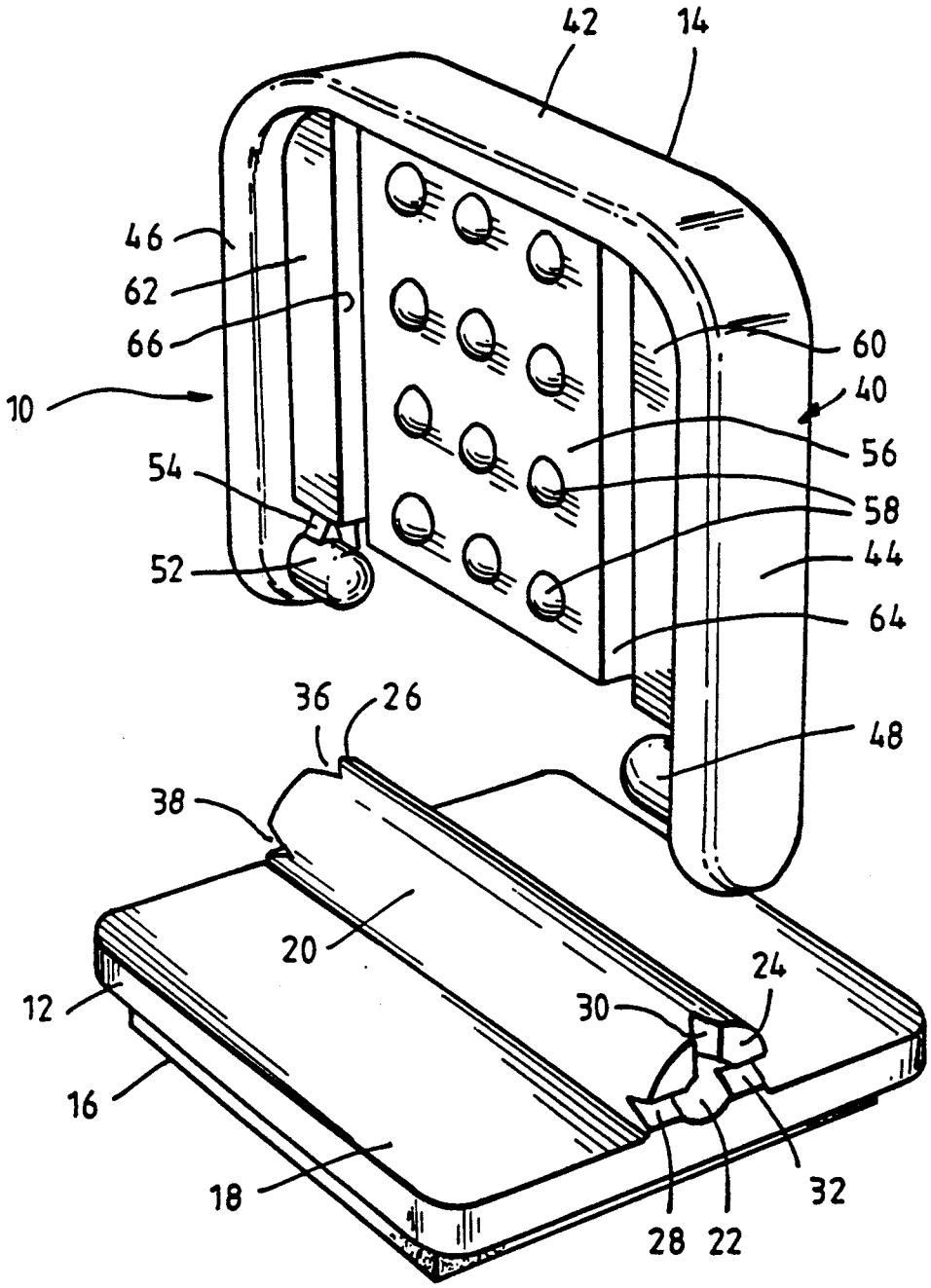
FIG. 1 is a perspective view of the embodiment of a hand stamp, with the folding handle and backing plate portion shown separately.

The hand or rubber stamp 10 includes a backing plate 12 and a handle 14. Secured to the underside of backing plate 12 is an impression block 16. It is to be understood that the impression block does not form part of the invention or of the embodiment, although of course a stamp would not be usable without such an impression block. However, stamp manufacturers normally supply stamps without impression blocks to stamp makers, who prepare the block with the appropriate impression and secure the block to the backing plate, before forwarding the stamp to the customer.

The hand stamp of the embodiment of the invention is intended to be used with an inked stamp pad, which are to be found in every office, and which is a readily transportable item, being generally flat.

Handle 14 and backing plate 12 are preferably formed from a thermoplastics material, and where desirable from a transparent thermoplastics material. The backing plate 12 could be adapted to use the arrangement disclosed in AU-B-86866/75 to provide a visual indication through the backing plate of the material on the impression block 16.

Backing plate 12 has a generally flattened cuboidal main body portion, with curved corners. Located centrally on the upper surface 18 of backing plate 12 and extending across surface 18 is a part-cylindrical portion 20 with an axial bore 22 extending therethrough.

At each end (24,26) of portion 20, there are three V-shaped notches 28,30,32 (in end 24) and 34,36,38 (in end 26) each of which extend from the outer surface of portion 20 to bore 22. Notches 28 and 32 are adjacent surface 18, whilst notch 30 is generally 90° from each of those notches. Similarly, notches 34 and 38 are adjacent surface 18, whilst notch 36 is generally 90° from those notches.

Handle 14 has a U-shaped outer portion 40 with an upper part 42 and legs 44,46. Extending inwardly from leg 44 is an axle 48, which has a generally cylindrical profile, with a curved outer end. A V-shaped lug 50 is located on the upper surface of axle 48, abutting leg 44. Similarly, there is an axle 52 and lug 54 arranged on leg 46.

Depending from upper part 42 is a main web 56, which has small protrusions 58 on its surfaces, as an aid to gripping the handle with the fingers. Lateral webs 60,62 are also provided, leaving gaps 64,66 between main web 56 and lateral webs 60,62. These gaps 64,66 may be reduced in length in that webs 56,60 and 62 may be joined near upper part 42. The purpose of the structure shown is to allow legs 44,46 flexibility to move outwards. Of course, selection of the material from which the handle is to be fabricated will contribute to the provision of such flexibility. A totally rigid or brittle material would be undesirable.

As has been stated hereinbefore, a preferred material is a thermoplastics material, and using such a material handle 14 and backing plate 12 would be individually moulded or fabricated, and subsequently assembled. The assembly would take place as follows.

Figure 4:
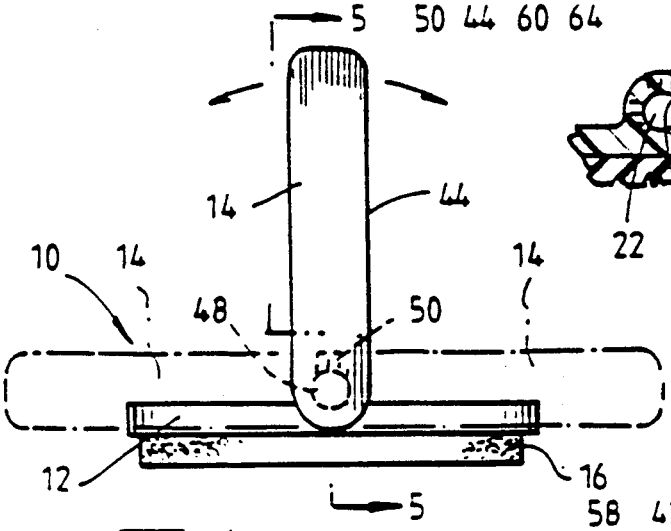
FIG. 4 is a side elevation of the stamp of FIG. 1, with the handle in the extended position.
Figure 6:
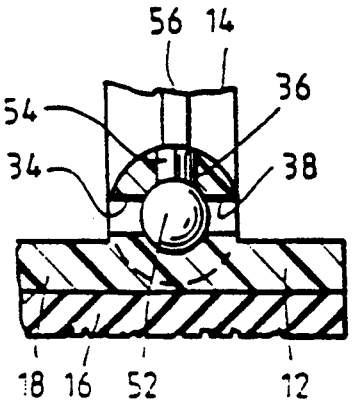
FIG. 6 is a cross-section along the lines 6—6 of FIG. 5.
Figure 5:
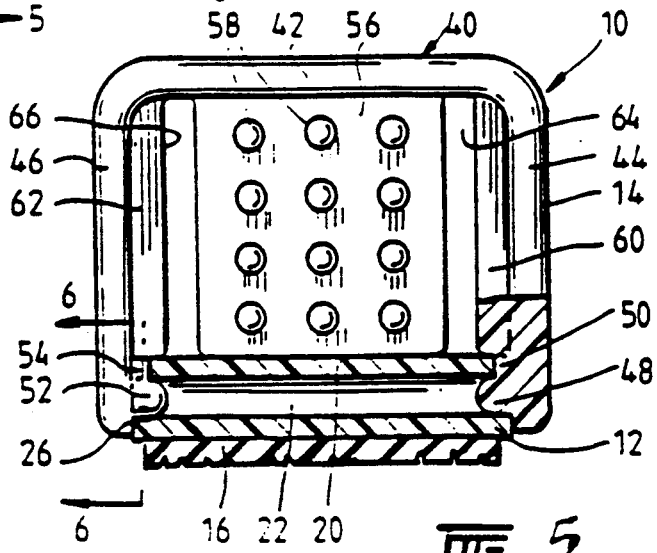
FIG. 5 is a cross-section along the line 5—5 of FIG. 4.

Legs 44,46 are bent outwards to a degree sufficient to allow axles 48,52 to enter bore 22 at ends 24,26 respectively. For legs 44,46 to return to their 'normal' position (that shown in FIGS. 2 and 5) lugs 50,54 must locate in one of notches 28,30,32 and 34,36,38 respectively. When lugs 50,54 are seated in notches 30,36 respectively (as shown in FIGS. 4 and 5) handle 14 will be in a position generally 90° to surface 18 of backing plate 12. When lugs 50,54 are located in notches 32,34 respectively handle 14 will be in the position shown in FIG. 2, adjacent surface 18. And when lugs 50,54 are located in notches 28,38 handle 14 will be in a position generally 180° from that shown in FIG. 2.

By virtue of the V-shaped design of elements located in the vicinity of the bore 22 comprising both lugs 50,54 and notches 28,30,32,34,36 and 38 formed in bore 22, when the lugs are located in particular notch, the handle will locate firmly but movably in one of the three positions shown and/or described. Whilst the handle is firmly held in each of the three positions, the flexibility of legs 44,46 allows them to flex outwards, causing axles 48,52 to partially withdraw from bore 22, and allowing the lugs 50,54 to ride out of the notches in which they are seated, when the handle is urged—usually manually—in the direction of rotation about bore 22, as shown by the arrows in FIG. 5, where all three positions—two in broken lines—are shown.

Figure 2:
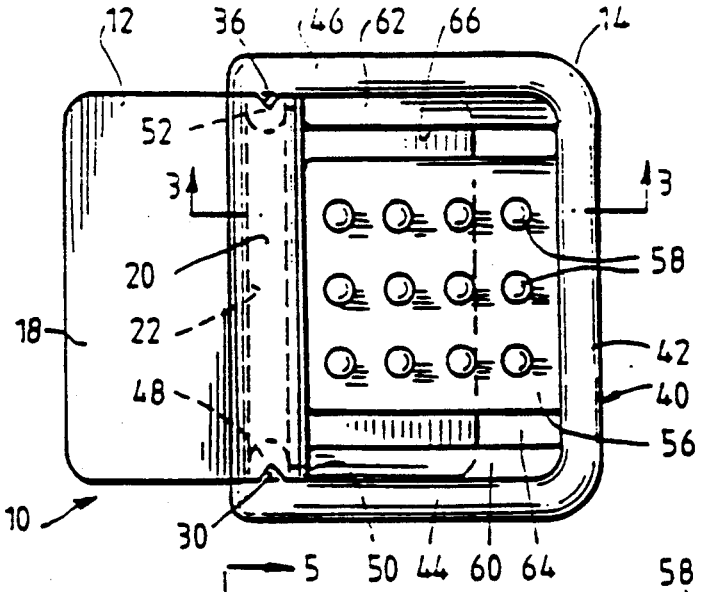
FIG. 2 is a top plan view of the stamp of FIG. 1, with the handle in a 'folded' position.
Figure 3:
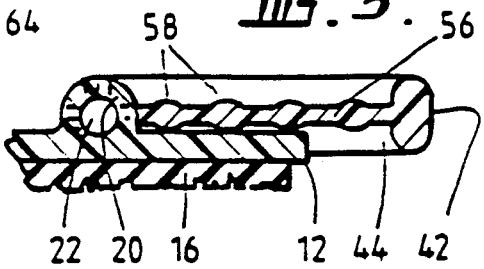
FIG. 3 is a cross-section along the lines 3—3 of FIG. 2.

As shown in FIGS. 2 and 5, the base of main web 56 abuts the cylindrical surface of element 20 of base 12. Such an arrangement imparts strength to handle 14, preventing movement of part 42 towards element 20.

In use, the stamp 10 is transported in the position shown in FIG. 2 or in the position 180° therefrom. When it is desired to use the stamp 10, the handle 14 is moved to the position shown in FIGS. 4 and 5 where it locks (to a certain extent) in position. The handle 14 grasped by the fingers on web 56 and protrusions 58 as conventional hand stamps are operated. When the operation has been completed, handle 14 may again be folded into one of the two aforementioned positions.

Preferably, the stamp is retained when not in use in a folder of vinyl or the like, with a cover which may be closed by a press-stud or the like. The folder may also have the ability to contain a small, flat stamp pad. Whether or not it is kept in a folder when not used, it can be seen that the present invention provides an improved transportable stamp which is particularly useful in executing documents relating to a corporation or a company.

It should be understood that the handle 14 need only be able to move between one transportation position and an operational position, and that other means may be utilized for such movement and any locking in a particular position.

I claim:

1. A stamp for applying a marking, including a handle and a base, said base forming or adapted to have secured to it an impression block for applying said marking, said handle being adapted to be manually gripped in order to effect the applying of said marking, said handle being adapted to be rotatable between an operational position in which said handle is located in a plane normal to that of said base and is generally upstanding relative to said base, and a transportation position in which said handle is located in a plane parallel to that of said base and generally adjacent to at least a portion of said base, said stamp being provided with means to firmly but releasably hold said handle in each of said operational position and said transportation position, said handle is provided with axle portions, and said means includes a bore associated with said base, said bore being adapted to cooperate with said axle portions located on said handle to permit rotation of said handle about said bore, said means further including elements being located in the vicinity of said bore and each of said axle portions releasably holding said handle in at least said operational position and said transportation position.

2. A stamp according to claim 1, wherein said elements are complementary notches and lugs.

3. A stamp according to claim 2, wherein a plurality of notches is located on said base in the vicinity of each end of said bore, and a lug is provided on respective axle portions of said handle.

4. A stamp according to claim 3, wherein said notches and lugs are so positioned to permit an operational position in which said handle is generally upstanding in relation to said base, and two transportation positions, in each of which said handle is generally adjacent said base.

5. A stamp according to claim 1 wherein said handle is substantially U-shaped, having an upper part and legs, and is provided with means for imparting strength to said handle, said means for imparting strength comprising a web member having one end extending from the upper part and a second end bearing on a portion of said base when said handle is in said operational position, said second end abutting said base.

* * * * *